US006647561B2

(12) United States Patent
Walton et al.

(10) Patent No.: US 6,647,561 B2
(45) Date of Patent: Nov. 18, 2003

(54) SPOOL

(75) Inventors: Robert Niven Walton, Nerang (AU); Lawrence John Walton, Nerang (AU); Duncan B Gilmore, Eight Mile Plains (AU); Nicholas D Agnew, Eight Mile Plains (AU)

(73) Assignee: Neumann Steel PTY Ltd., Queensland (AU)

( * ) Notice: Subject to any disclaimer, the term of this patent is extended or adjusted under 35 U.S.C. 154(b) by 19 days.

(21) Appl. No.: 10/149,581

(22) PCT Filed: Dec. 15, 2002

(86) PCT No.: PCT/AU00/01546

§ 371 (c)(1),
(2), (4) Date: Jun. 14, 2002

(87) PCT Pub. No.: WO01/44602

PCT Pub. Date: Jun. 21, 2002

(65) Prior Publication Data

US 2002/0189009 A1 Dec. 19, 2002

(30) Foreign Application Priority Data

Dec. 16, 1999 (AU) ..... PQ 4733

(51) Int. Cl.[7] ..... E04H 4/00

(52) U.S. Cl. ..... 4/502; 4/498; 135/115; 135/903; 160/370.22

(58) Field of Search ..... 4/498–503; 135/115, 135/903; 160/120, 121.1, 133, 243, 254, 370.22; 242/590

(56) References Cited

U.S. PATENT DOCUMENTS

| | | | | |
|---|---|---|---|---|
| 3,292,684 A | * | 12/1966 | Jines | 160/370.22 |
| 4,351,072 A | | 9/1982 | Smith | 4/503 |
| 4,471,500 A | | 9/1984 | Long et al. | 4/499 |

FOREIGN PATENT DOCUMENTS

| | | |
|---|---|---|
| DE | 1 684 697 | 4/1971 |
| DE | 25 18 697 | 11/1976 |
| DE | 30 00 396 | 7/1981 |
| FR | 1.207.985 | 2/1960 |
| GB | 2 148 366 | 5/1985 |
| WO | WO 97/06335 | 2/1997 |
| ZA | 81/7858 | 10/1982 |

* cited by examiner

*Primary Examiner*—Tuan N. Nguyen
(74) *Attorney, Agent, or Firm*—Nixon & Vanderhye, P.C.

(57) ABSTRACT

A spool for use with a swimming pool cover or with a shade cover. The spool has a roller assembly, and a cover (not shown) may be wound onto the roller assembly or unwound from the assembly. The roller assembly has a pre-tensioned rubber strip that when viewed in transverse cross-section is substantially rectangular in shape and two opposing sides of the rectangle are notched. This strip is tensioned when the cover is unwound from the spool and a locking mechanism retains the cover in a desired unwound position against the tension of the rubber strip.

16 Claims, 7 Drawing Sheets

SPOOL

This application is the US national phase of international application PCT/AU00/01546 filed Dec. 15, 2000 which designated the U.S.

TECHNICAL FIELD

This invention relates to a spool. In particular, the invention concerns a spool for a swimming pool cover or for a shade cover, for allowing the cover to be unwound from the spool and returned to a retracted wound position relative to the spool.

The invention will be described by way of example with reference to its use with a cover for a swimming pool and with a cover for providing shade. It should be appreciated that this is by way of example only and that the spool may be used with a web or cover intended for other purposes.

BACKGROUND ART

Where swimming pools are heated, covers are used and arranged to extend over the surface of the pool to retain heat within the water when the pool is not in use. The cover is mounted on a spool which allows the cover to be wound onto the spool in a retracted position when the pool is in use and allows the cover to be unwound from the spool so that it extends over the pool when the pool is not in use.

Unwinding and retracting of the cover relative to the spool may be achieved in a manual fashion or the spool may be driven by a motor. Manual operation of such spools is tedious. Motor driven operation is preferred but has its disadvantages. A source of electric power needs to be available to drive the spool and having electrical appliances near wet areas such as swimming pool surrounds or exposed to the elements is undesirable. In addition, motor driven spools of this type are relatively expensive. Likewise, spools used to extend and retract shade covers have similar disadvantages.

SUMMARY OF THE INVENTION

It is an object of the present invention to provide a spool for covers or the like which at least minimises the disadvantages referred to above.

According to a first aspect of the invention, there is provided a spool for covers, the spool having a roller assembly, at least one cover attached to the roller assembly and adapted to be wound onto the roller assembly and unwound from the assembly, the roller assembly including a rubber member that when viewed in transverse cross-section is substantially rectangular in shape and two opposing sides of the rectangle are notched, which member may be tensioned when the cover is unwound from the spool.

Preferably, the notches in the rubber member are V-shaped.

As the cover is unwound from the spool, the rubber member may generate torque that initially increases at a rapid rate, following which the amount of torque generated may drop to a rate of increase lower than that initially until the cover is in a fully extended position.

Preferably, the rubber member comprises a rubber strip that extends along the roller assembly. The rubber member may be pre-tensioned such that when the cover is fully retracted the rubber member is still under tension. Preferably the member comprises natural rubber and has a Shore hardness of 50.

The roller assembly may include a sleeve about which the cover may be wound. The rubber member may be located within the sleeve. The roller assembly may have at least one handwheel.

More than one cover may be attachable to the roller assembly. For instance, two covers may be attached to the roller assembly, at opposing sides of the sleeve.

The spool may have a releasable locking mechanism operable for retaining the cover in a desired unwound position against the tension of the rubber member. When the locking mechanism has been released, the cover may be wound onto the roller assembly.

The roller assembly may have opposed shafts securely fixed to opposed ends of the rubber member. One of these shafts may be mounted for rotation and the other may be received by the locking mechanism and may selectively be held against rotation by the locking mechanism or released by the locking mechanism to allow it to rotate.

The locking mechanism may include a ratchet and pawl arrangement. The pawl or pawls may be carried by the roller assembly and the ratchet may be carried by the shaft that is received by the locking mechanism. Alternately, the shaft that is received by the locking mechanism may be fixed to a hub having at least one aperture, and the locking mechanism may include a locating pin that is located relative to the hub, and the locating pin may be moved to engage the aperture.

The spool may be carried by a stand consisting of two or more spaced stand members. Each stand member may receive an end of a respective said opposed shaft.

The spool may be used with a pool cover. The spool may be used with a shade cover.

According to a second aspect of the invention, there is provided a shade cover assembly having:

a roller assembly, at least one cover attached to the roller assembly and adapted to be wound onto the roller assembly and unwound from the assembly, the roller assembly including a rubber member that when viewed in transverse cross-section is substantially rectangular in shape and two opposing sides of the rectangle are notched, which member may be tensioned when the cover is unwound from the spool; and a plurality of substantially vertical stand members, wherein the spool is adjustably mounted to two of the members, and when the cover is extended, a free end of the cover may be adjustably mounted to at least one other member, wherein the spool and the free end of the cover may be raised or lowered relative to the members independently of one another.

BRIEF DESCRIPTION OF THE DRAWINGS

Particular preferred embodiments of the invention will now be described by way of example with reference to the drawings in which.

BEST MODE AND OTHER MODES OF CARRYING OUT THE INVENTION

Figure 1:
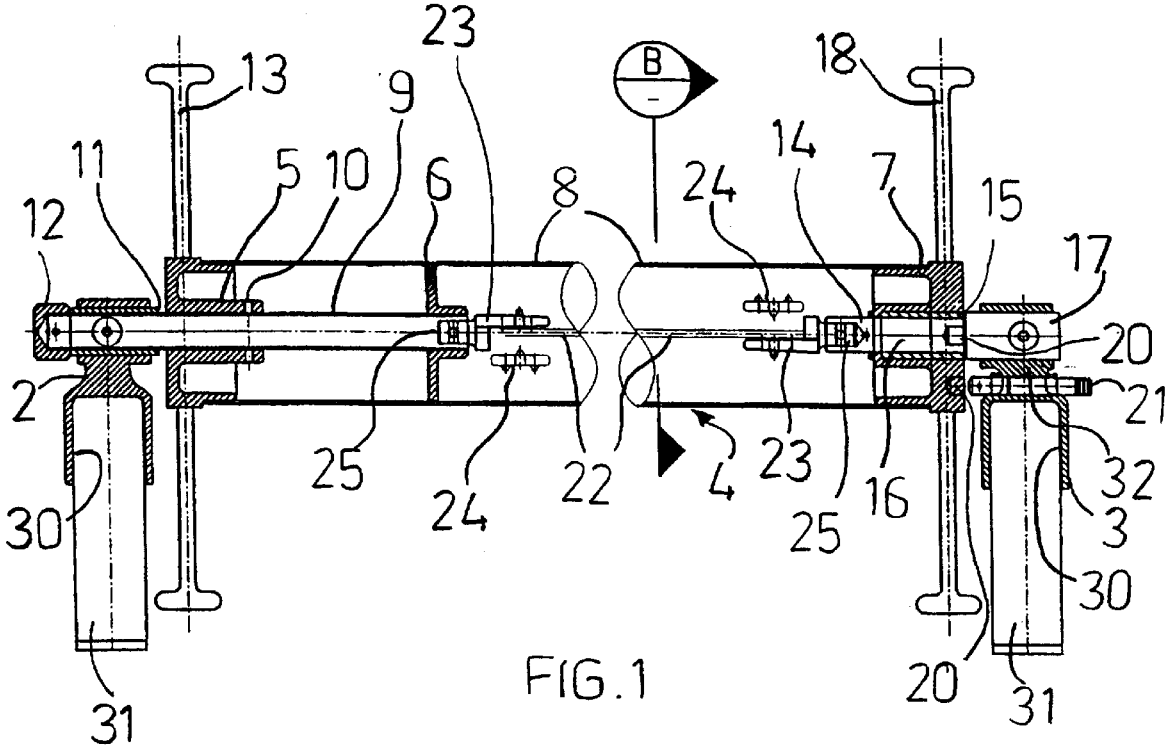
FIG. 1 is a longitudinal sectional view of a spool connected to a stand according to a first embodiment of the invention.
Figure 2:
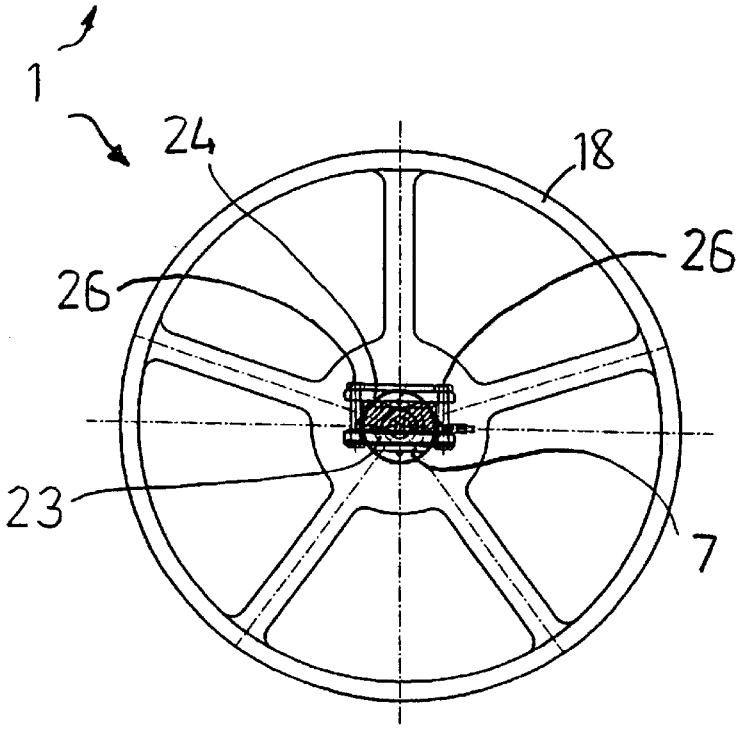
FIG. 2 is a transverse cross-sectional view of the spool taken along line BB of FIG. 1.

Referring first to FIGS. 1 and 2, there is shown a spool 1 according to a first embodiment of the invention. The spool 1 has a roller assembly 4 that extends between two stand members 2 and 3. The roller assembly 4 has three hubs 5, 6, 7, three shafts 9, 14, 16, a spigot 17, two sets of clamping plates 23, 24, a rubber strip 22, a sleeve 8, and two handwheels 13, 18.

The hubs 5, 6, 7 are fixed to the sleeve 8. A first shaft 9 of the assembly 4 extends through hubs 5 and 6 and is fixed to hub 5 with a fastener 10, and an end of shaft 9 is received for rotation by a bush 11 carried by stand member 2. This end of shaft 9 is pinned to a cap 12. Handwheel 13 is fixed to hub 5.

The opposite end of the roller assembly 4 has a second but shorter shaft 14 that is fixed to a third shaft 16. A bush 15 is fitted to the hub 7 and rotates on shaft 16. A spigot 17 extends from the hub 7 and is received in an aperture formed in stand member 3. A handwheel 18 extends about and is fixed to hub 7.

Hub 7 has two apertures 20 (see FIG. 1) spaced about a face of hub 7 for receiving an end of a slideable locating pin 21 of stand member 3. When locating pin 21 engages an aperture 20 of the hub 7, then the roller assembly 4 is not able to revolve.

The roller assembly 4 has a strip of natural rubber 22, having a Shore hardness of 50, that is pre-tensioned by winding. Each end of the rubber strip 22 is clamped between two plates 23, 24 with fasteners 26 (see FIG. 2). Plate 23 has a finger 25 that is pinned to an end of an adjacent shaft 9 or 14 (see FIG. 1)

Figure 3:
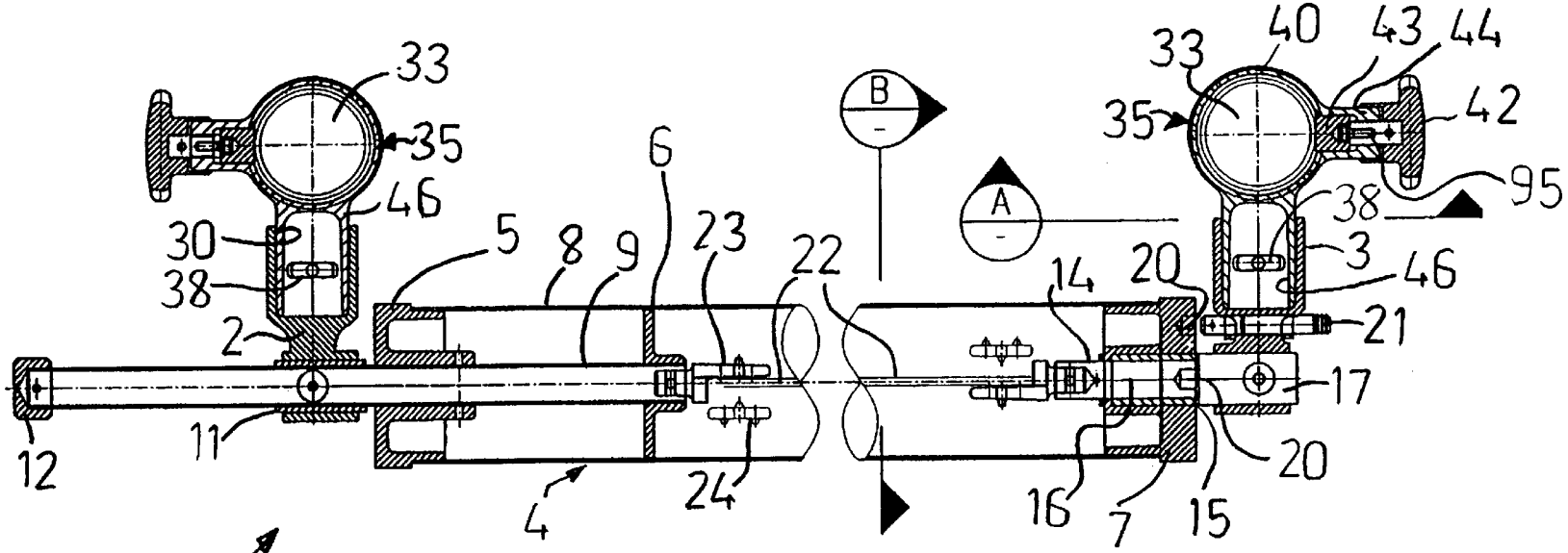
FIG. 3 is a longitudinal sectional view of a spool connected to a stand according to a second embodiment of the invention.
Figure 4:
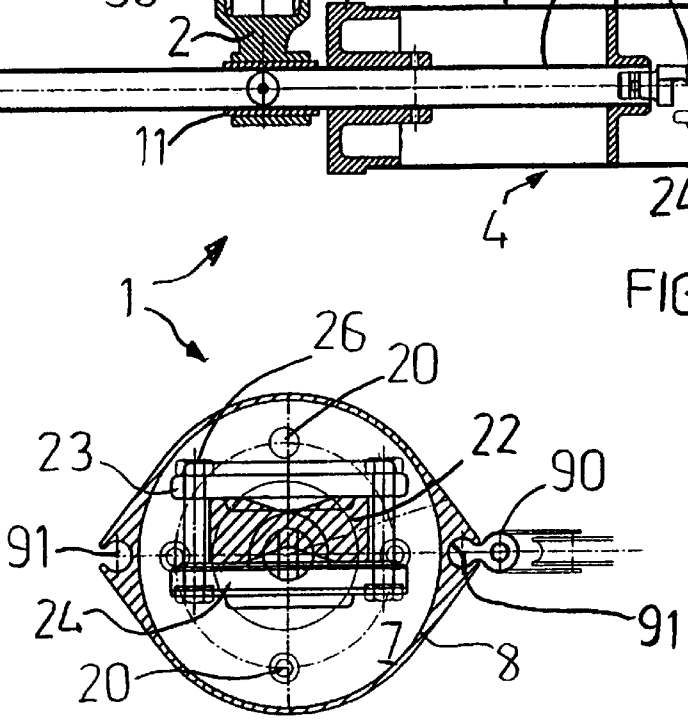
FIG. 4 is a transverse cross-sectional view of the spool taken along line BB of FIG. 3.

FIGS. 3 and 4 show a spool 1 for use with a shade cover, according to a second embodiment of the invention. This spool 1 is virtually identical to the spool of FIGS. 1 and 2, except that it lacks handwheels 13 and 18. The sleeve 8 also has a groove 91 extending the length of the sleeve 8 for receiving a fixing strip 90 that attaches to an end of the cover (not shown). Fixing strip 90 has a bead that is located within groove 91. If desired, two covers may be attachable to opposing sides of the sleeve 8 of FIG. 4. FIG. 4 also shows that the hub 7 has two apertures 20 for receiving the locating pin 21.

Referring now to the spool 1 of FIGS. 1 and 2, or to the spool of FIGS. 3 and 4, when the cover is unwound from the sleeve 8, the end of the rubber strip 22 adjacent shaft 14 remains stationary, whereas the end of the rubber strip 22 adjacent shaft 9 revolves with the sleeve 8. In this way, the rubber strip 22 is twisted and tensioned against its resiliency. With the cover extended to a desired extent, the locating pin 21 is moved into engagement with an aperture 20 of the hub 7 such that the roller assembly 4 cannot revolve. To retract the cover, the locating pin 21 is first removed from the aperture 20, then the cover is wound onto the revolving roller assembly 4 by means of the tensioned rubber strip 22. Of course, a free end of the cover may be anchored such that the roller assembly 4 need not have a locking mechanism.

Figure 6:
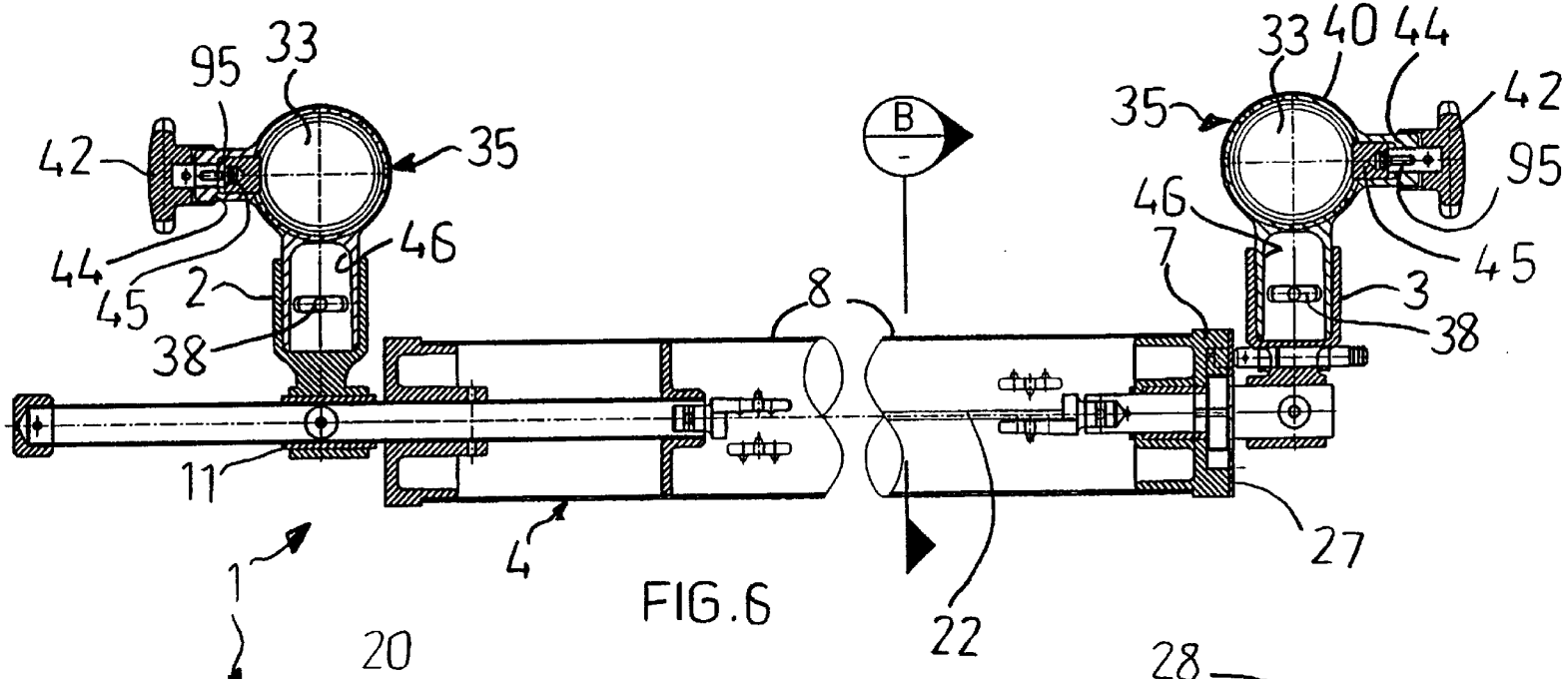
FIG. 6 is a longitudinal sectional view of a spool connected to a stand according to a third embodiment of the invention.
Figure 8:
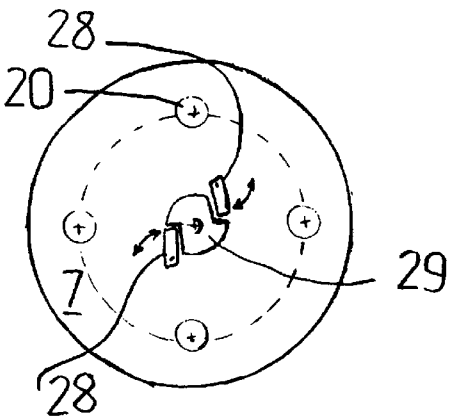
FIG. 8 is a side elevational view of part of the spool of FIG. 6 showing a ratchet and pawl locking mechanism, and the arrows indicate how the pawls may move.
Figure 7:
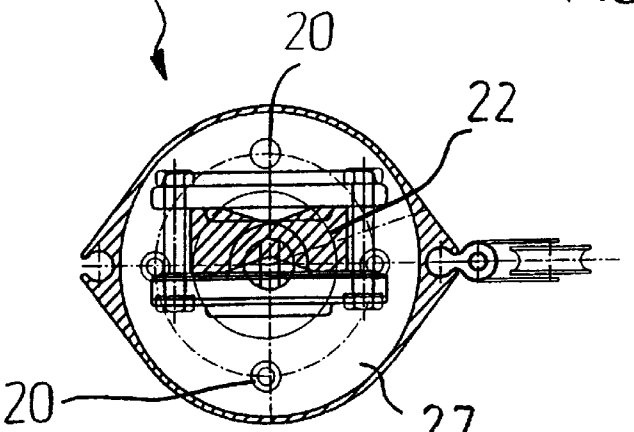
FIG. 7 is a transverse cross-sectional view of the spool taken along line B—B of FIG. 6.

Referring now to FIGS. 6, 7 and 8, there is shown a third embodiment of the spool. This spool 1 differs from the other embodiments in that it has an additional locking mechanism to that of the locating pin 21, namely a ratchet and pawl arrangement. FIG. 6 shows a ratchet plate 27 fastened to hub 7. FIG. 8 shows two opposed tubular shaped pawls 28 which pivot into and out of engagement with ratchet 29. When the cover is unwound from the sleeve 8, the sleeve 8 rotates and the rubber strip 22 is twisted and tensioned and the pawls 28 disengaged from the ratchet 29 and the sleeve 8 is allowed to rotate. With the cover extended to a desired extent, the cover is allowed to slowly retract a small amount and the pawls 28 thereby engage the ratchet 29 and the spool 1 is then in a locked state with the cover extended. To retract the cover, the cover is extended slightly to disengage the pawls 28 from the ratchet 29 and then allowed to retract at a faster rate under the influence of the rubber strip 22. This causes the pawls 28 to be flung out due to centrifugal force and the rubber strip 22 causes the cover to be rewound onto the sleeve 8.

The spool 1 of FIGS. 1 and 2 may be used with a swimming pool cover. Stand members 2 and 3 each have a sleeve 30 that receives an end of an upstanding post 31. The other end of the post 31 is anchored to the ground or to an edge of the pool to keep the spool 1 stationary. FIG. 1 shows that stand member 3 has a neck region 32 that contains an aperture for locating pin 21.

Figure 9:
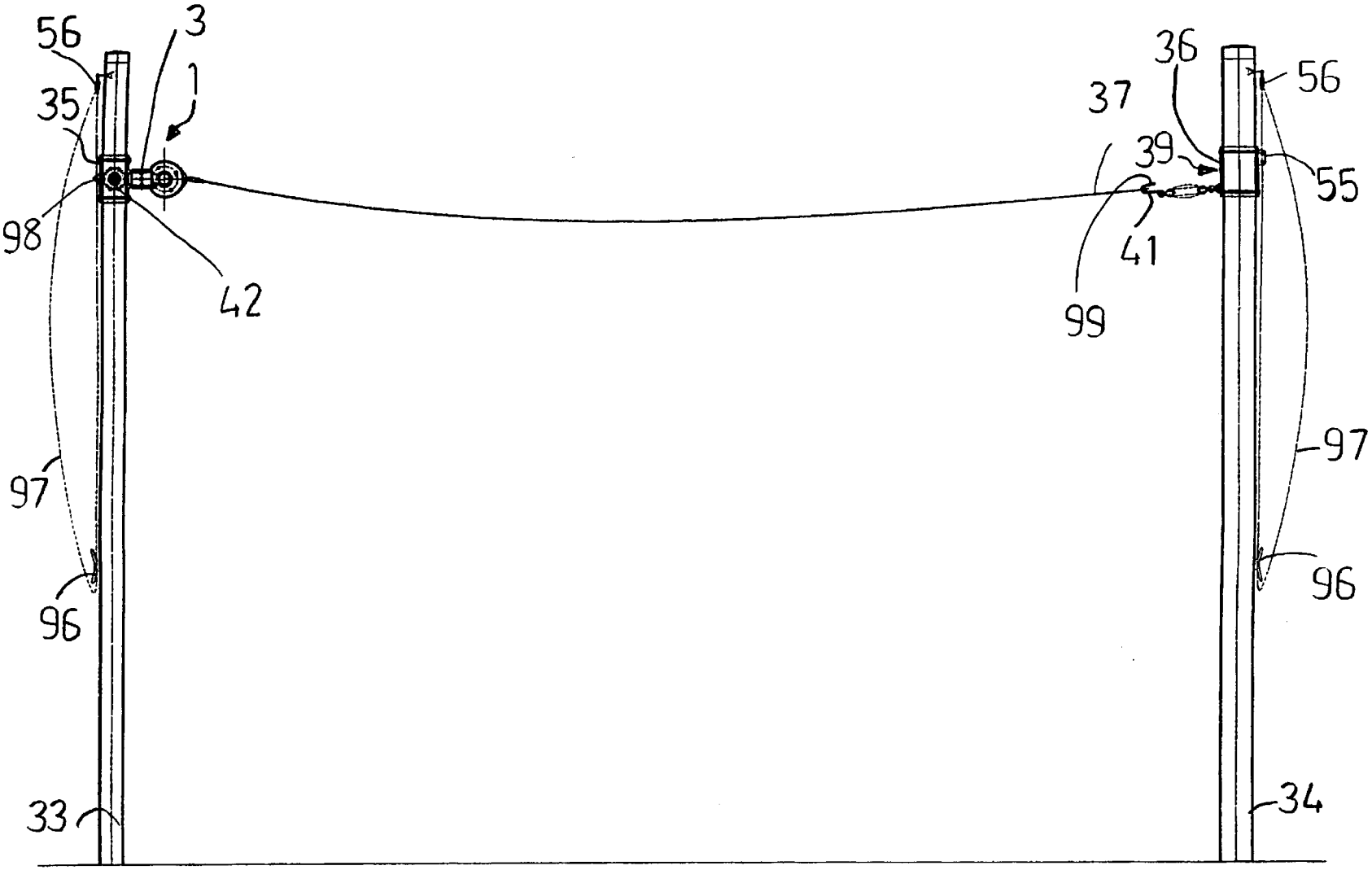
FIG. 9 is a side elevational view of a shade cover assembly having the spool of FIG. 3 or FIG. 6, according to an embodiment of the invention.

FIG. 9 shows the spool 1 of FIGS. 3 and 4 or FIGS. 6–8 when used with a shade cover 37. The spool 1 is attached to two upstanding posts 33, only one of which is shown. The cover 37 of FIG. 9 has been extended and is triangular in shape. A free end of the cover 41 is attached to another upstanding post 34.

Figure 5:
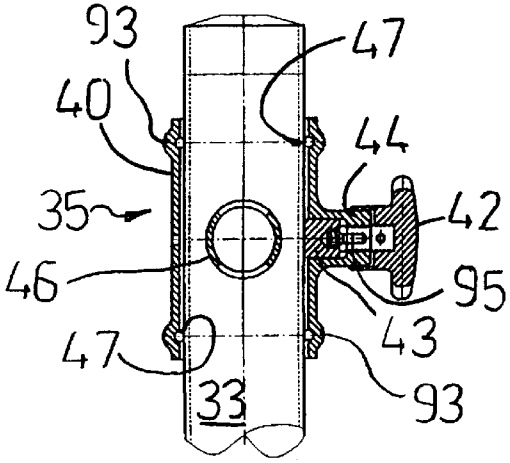
FIG. 5 is a transverse cross-sectional view of the stand taken along line AA of FIG. 3.

Details of how the spool 1 of FIG. 9 is attached to posts 33 are shown in FIGS. 3, 5 and 6. These figures show that stand members 2 or 3 are each adjustably mounted to a post 33 by a collar assembly 35. Collar assembly 35 has a collar 40, a first spigot 46 that extends at a right angle from collar 40, a second spigot 44 that has a threaded end, a handle 42 that is attached to the threaded end of the second spigot 44, and a lug with eyes 98.

The stand members 2, 3 are attached to the first spigots 46 of the collar assemblies 35 with fasteners 38. The handle 42 is coupled to a locking member 43 with a spindle 95 located within the second spigot 44. When the handle 42 is turned in a first direction, the locking member 43 is moved towards and bears against the post 33, and when the handle 42 is turned in the other direction, then the locking member 43 disengages the post 33. In this way, the collar assembly 35 may be locked to the post 33 at different heights above the ground. The collar 40 of assembly 35 also has two annular ridges 93, each of which houses an O-ring seal 47 (see FIG. 5).

FIG. 9 shows the free end of the cover 41 is attached to post 34 by a collar assembly 39. This collar assembly 39 has a collar 36, a lug with eyes 55 attached to the collar 36, and a hook 99 coupled to the collar 36. The hook 99 is attached to end 41 of the cover 37.

Pulley wheels 56 are attached to the tops of posts 33 and 34 and cleats 96 are fixed to lower regions of the posts 33, 34. A rope 97 passes through each pulley 56 and is attached to either the lug 55 of collar assembly 39 or to the lug 98 of collar assembly 35. With this arrangement, collar assembly 35 or assembly 39 may be raised or lowered using the rope 97 and locked into position by tying the rope 97 to the cleat 96. Additionally, collar assembly 39 may be adapted such that it cannot slide along the post 34 when under tension.

The collar assemblies 35, 39 are slideable along the posts 33, 34 and may be locked at any desired location along the posts 33, 34. In this way, the free end 41 of the cover 37 may be raised or lowered relative to the spool 1. Moreover, shaft 9 of the roller assembly 4 of FIGS. 3 and 6 extends beyond bush 11 such that the roller assembly 4 may be angled as required in order to cast shade on an area below the cover 37.

Figure 10:
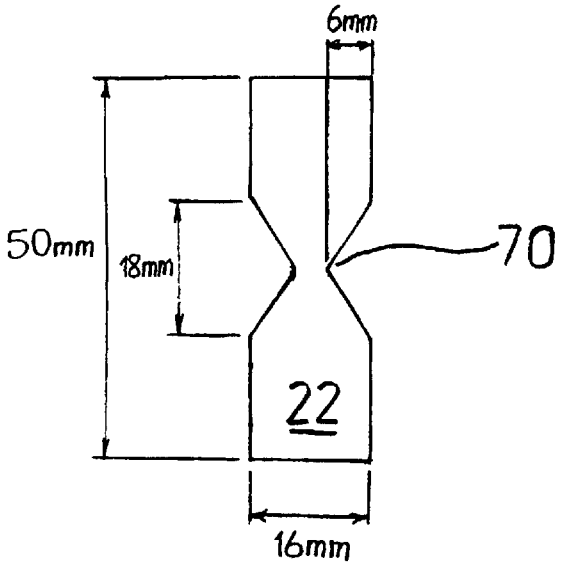
FIG. 10 is a transverse cross-sectional view of a notched rubber strip of the spool of any one of the above figures, according to an embodiment of the invention.

Referring now to FIG. 10, there is shown a detailed transverse cross-sectional view of the rubber strip 22. Rubber strip 22 is substantially rectangular in shape and has two opposing sides each with a V-shaped notch 70.

Figure 11:
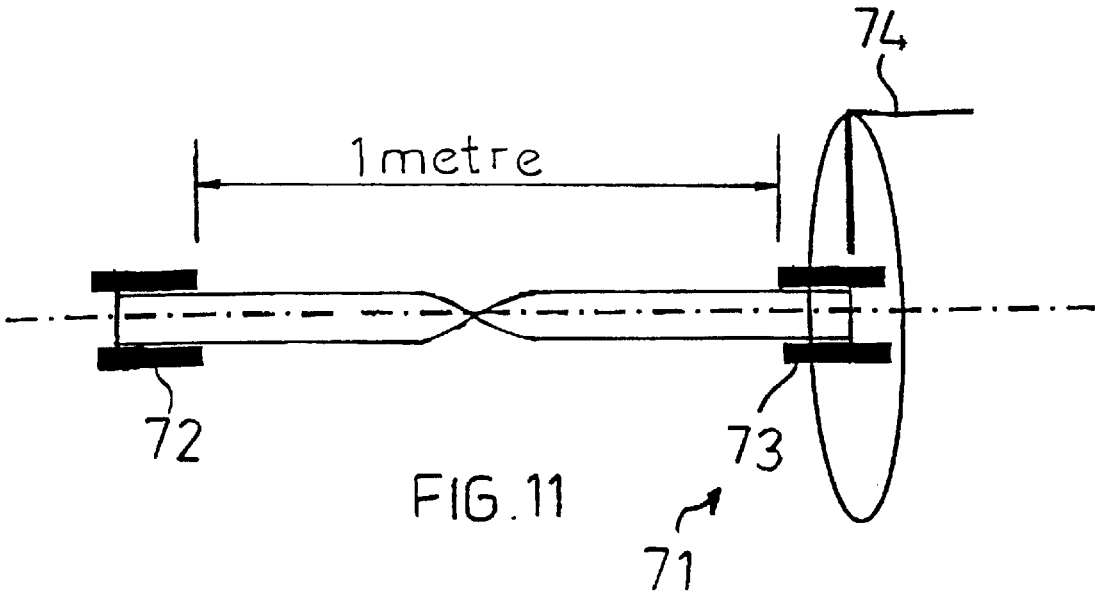
FIG. 11 shows a test rig used to test the tensioning properties of rubber strips having different transverse cross-sections, including the notched rubber strip of FIG. 10.

FIG. 11 shows a test rig 71 that was used to determine the tensioning properties of rubber strips having different transverse cross-sections, including the notched rubber strip 22 of the present invention. One end of each rubber strip was clamped at 72, and the other end of the rubber strip was clamped at 73. To allow the strip to be tensioned, the end at 73 is rotable through complete revolutions relative to the end at 72 by using handle 74.

Figure 12:
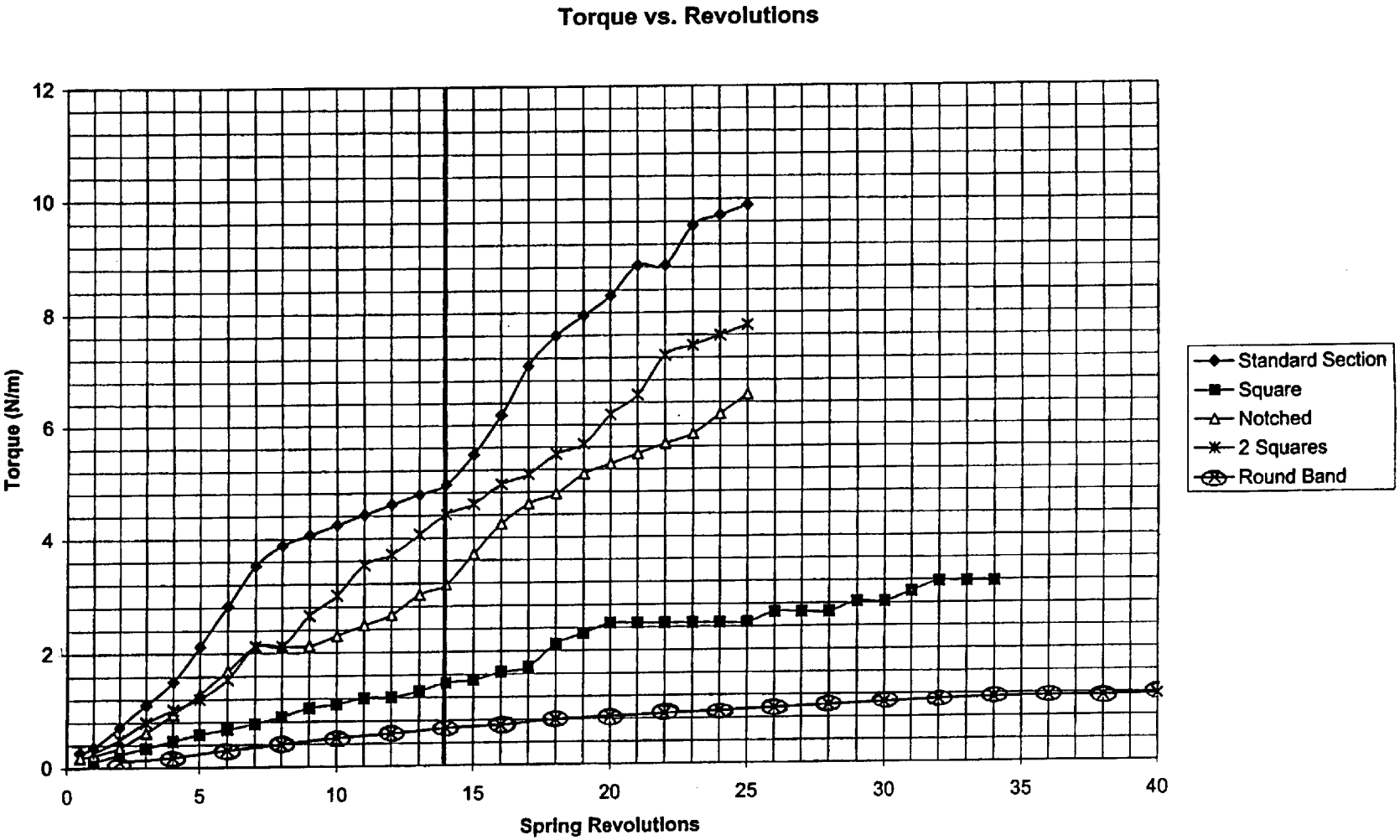
FIG. 12 shows a graph that plots the absolute torque generated by tensioning various rubber strips with the test rig of FIG. 11, including the notched rubber strip of FIG. 10.

FIG. 12 shows a graph of absolute torque (in N/m) generated by tensioning (in revolutions) various rubber strips employing the test rig 71. Referring now to the legend of FIG. 12, "standard section" denotes a rubber strip having a rectangular cross-section, "square" denotes a rubber strip having a square cross-section, "2 squares" denotes a rubber strip having a cross-section resembling two adjoined squares, and "round band" denotes a rubber strip having a round cross-section.

FIG. 12 indicates that as the cover is unwound from the spool, the notched rubber strip 22 generates torque that initially increases at a rapid rate (revolutions 1 to 7), following which the amount of torque generated decreases to a rate of increase lower than that experienced during initial unwinding (beginning at revolution 8) until the cover reaches a fully extended position at revolution 14. After the 14th revolution, a 1 m long notched rubber strip having the dimensions shown in FIG. 10 begins to buckle. This rapid initial rate of increase in torque is desirable as it ensures that the cover will be wound fully onto the spool when being retracted, and the subsequent lower rate of increase ensures that a person will be able to extend (ie. pull) the cover fully without the need for a high pull force (see FIG. 13). In comparison with the notched rubber strip 22, the graph of FIG. 12 clearly shows that a rubber strip having a round cross-section is unsuitable for use in the spool of the present invention.

Figure 13:
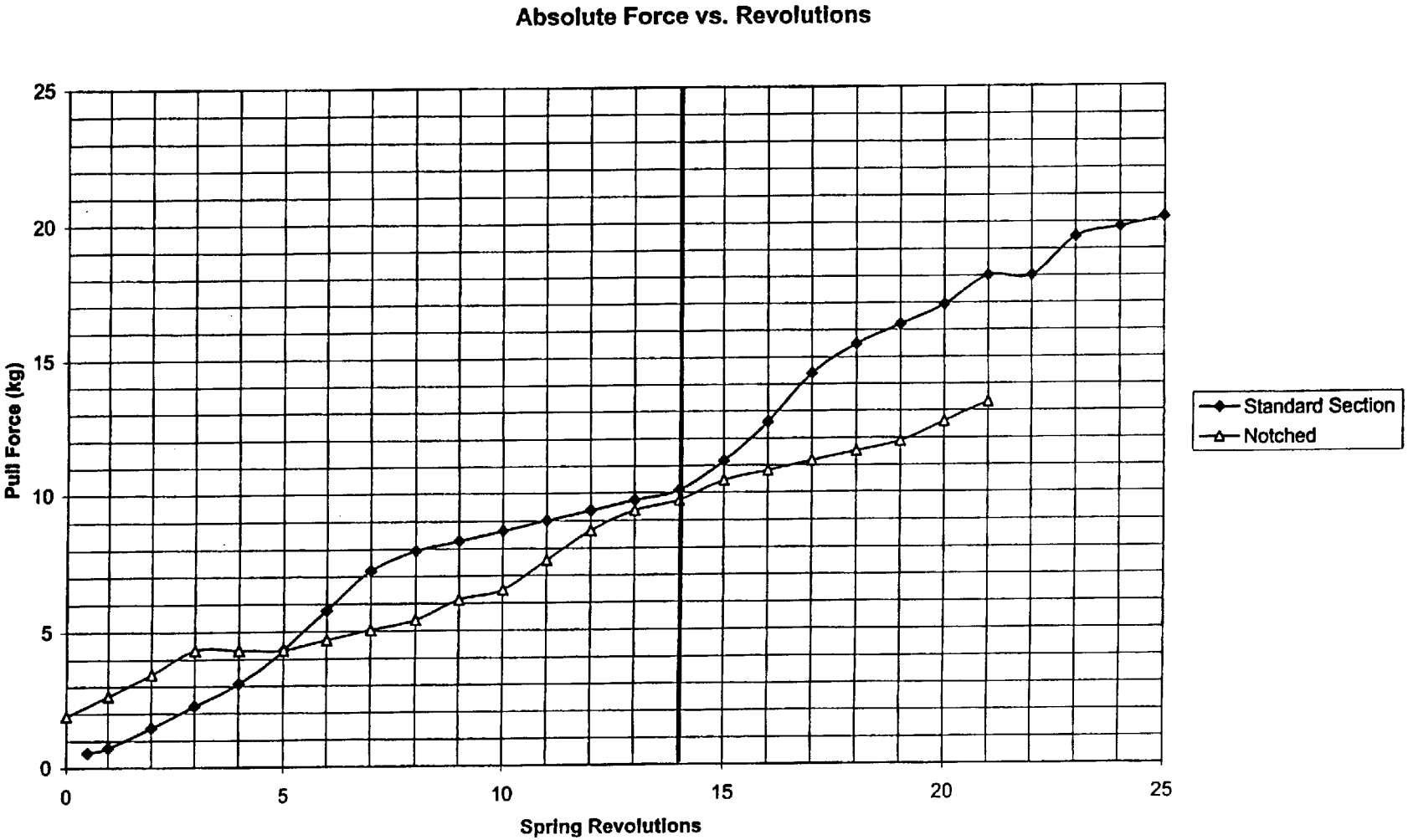
FIG. 13 shows a graph that plots the pull force of various rubber strips, including the rubber strip of FIG. 10.

FIG. 13 shows a graph that is essentially identical to the graph of FIG. 12, except the graph indicates the approximate pull force required to extend the cover when the notched rubber strip 22 is pre-tensioned through about four revolutions. Also plotted is the pull force required to extend a cover using a rubber strip having a rectangular cross-section (labelled "standard section"). The graph indicates that to extend a cover from a spool having a pre-tensioned notched rubber strip 22 will require a fairly constant pull force of up to about 10 kg (at revolution 14), whereas in comparison, using a pre-tensioned rubber strip of rectangular cross-section will require a higher constant pull force with a maximum force of about 15 kg (at revolution 18)—which makes it less useful for the purposes of the spool of the present invention.

What is claimed is:

1. A spool for covers, the spool having a roller assembly, at least one cover attached to the roller assembly and adapted to be wound onto the roller assembly and unwound from the assembly, the roller assembly including a rubber member that when viewed in transverse cross-section is substantially rectangular in shape and two opposing sides of the rectangle are notched, which member may be tensioned when the cover is unwound from the spool.

2. The spool of claim 1, wherein the notches in the rubber member are V-shaped.

3. The spool of claim 1, wherein the rubber member comprises a rubber strip that extends along the roller assembly.

4. The spool of claim 1, wherein the rubber member may be pre-tensioned such that when the cover is fully retracted the rubber member is still under tension.

5. The spool of claim 1, wherein the rubber member comprises natural rubber having a Shore hardness of 50.

6. The spool of claim 1, wherein the roller assembly includes a sleeve about which the cover may be wound, and the rubber member is located within the sleeve.

7. The spool of claim 1, wherein the roller assembly includes at least one handwheel.

8. The spool of claim 1, wherein the spool has a releasable locking mechanism operable for retaining the cover in a desired unwound position against the tension of the rubber member.

9. The spool of claim 8, wherein the roller assembly has opposed shafts securely fixed to opposed ends of the rubber member, and one of these shafts is mounted for rotation and the other is received by the locking mechanism and may selectively be held against rotation by the locking mechanism or released by the locking mechanism to allow it to rotate.

10. The spool of claim 9, wherein the shaft that is received by the locking mechanism is fixed to a hub having at least one aperture, and the locking mechanism includes a locating pin that is located relative to the hub, and the locating pin may be moved to engage the aperture.

11. The spool of claim 9, wherein the locking mechanism includes a ratchet and pawl arrangement, wherein at least one pawl is carried by the roller assembly and the ratchet is carried by the shaft that is received by the locking mechanism.

12. The spool of claim 1, wherein the spool is carried a stand consisting of two spaced stand members.

13. The spool of claim 12, wherein each stand member receives an end of a respective said opposed shaft.

14. The spool of claim 1 when used with a pool cover.

15. The spool as claimed in claim 1 when used with a shade cover.

16. A shade cover assembly having:

a roller assembly, at least one cover attached to the roller assembly and adapted to be wound onto the roller assembly and unwound from the assembly, the roller assembly including a rubber member that when viewed in transverse cross-section is substantially rectangular in shape and two opposing sides of the rectangle are notched, which member may be tensioned when the cover is unwound from the spool; and a plurality of substantially vertical stand members, wherein the spool is adjustably mounted to two of the members, and when the cover is extended, a free end of the cover may be adjustably mounted to at least one other member, wherein the spool and the free end of the cover may be raised or lowered relative to the members independently of one another.

* * * * *

UNITED STATES PATENT AND TRADEMARK OFFICE

CERTIFICATE OF CORRECTION

PATENT NO. : 6,647,561 B2
DATED : November 18, 2003
INVENTOR(S) : Walton et al.

It is certified that error appears in the above-identified patent and that said Letters Patent is hereby corrected as shown below:

Title page,
Item [22], should read as follows:
-- [22] PCT Filed: Dec. 15, 2000 --

Signed and Sealed this

Fourth Day of May, 2004

JON W. DUDAS
*Acting Director of the United States Patent and Trademark Office*